US006186077B1

(12) United States Patent
Lim et al.

(10) Patent No.: US 6,186,077 B1
(45) Date of Patent: Feb. 13, 2001

(54) PREFABRICATED PALLET

(76) Inventors: Bang-Hoon Lim; Hoe-Youn Lim; Yong-Suk Lim; Jae-Sung Lim, all of 890-2, Bangbae-dong, Seocho-ku, Seoul (KR)

( * ) Notice: Under 35 U.S.C. 154(b), the term of this patent shall be extended for 0 days.

(21) Appl. No.: 09/402,597

(22) PCT Filed: Apr. 1, 1998

(86) PCT No.: PCT/KR98/00077

§ 371 Date: Oct. 4, 1999

§ 102(e) Date: Oct. 4, 1999

(87) PCT Pub. No.: WO98/45178

PCT Pub. Date: Oct. 15, 1998

(30) Foreign Application Priority Data

Apr. 4, 1997 (KR) ..... 97-6997

(51) Int. Cl.[7] ..... B65D 19/12
(52) U.S. Cl. ..... 108/56.1; 108/57.17
(58) Field of Search ..... 108/51.11, 53.5, 108/56.1, 56.3, 57.17, 57.18, 57.19, 57.2, 901

(56) References Cited

U.S. PATENT DOCUMENTS 3,878,796 * 4/1975 Morrison ..... 108/56.1
4,359,948 11/1982 Judy et al. .
4,869,179 * 9/1989 Sammons et al. ..... 108/56.1
5,218,913 6/1993 Wineberger et al. .
5,417,167 5/1995 Sadr .

FOREIGN PATENT DOCUMENTS

2604978 A1 4/1988 (FR) .
2 281 280 3/1995 (GB) .
3256846 * 11/1991 (JP) ..... 108/56.1

* cited by examiner

*Primary Examiner*—Janet M. Wilkens
(74) *Attorney, Agent, or Firm*—DeLio & Peterson, LLC

(57) ABSTRACT

A pallet having a plurality of horizontal plastic members (1) are arranged in a parallel arrangement and individually have a plurality of vertical fitting holes. A plurality of vertical plastic members (2) are arranged on and across the horizontal members at right angles and individually have a plurality of fitting block parts on the bottom surface of a longitudinal part. The block parts are fitted into the fitting holes of the horizontal members (1), thus assembling the two types of members into a pallet without using any nails, screws, or rivets or the crosses. The vertical members individually have a pipe insert hole (7) at a position around each of the block parts, thus allowing the pallet to be selectively formed as a many-storied structure.

3 Claims, 6 Drawing Sheets

PREFABRICATED PALLET

TECHNICAL FIELD

The present invention relates, in general, to pallets used for handling, storing, or moving materials and packages in warehouses, factories, or vehicles and, more particularly, to a prefabricated pallet capable of being easily and firmly assembled by fitting a plurality of vertical and horizontal members to each other and easily disassembled when necessary.

BACKGROUND ART

As well known to those skilled in the art, pallets are portable platforms used for handling, storing, or moving materials and packages (raw materials, semiprocessed goods, or end-products) in warehouses, factories, or vehicles. When it is necessary to move materials and packages with such pallets using a fork-lift truck, the pallets do not remain on the support surface but are lifted and moved by the fork-lift truck along with the materials and packages.

Typical pallets, used for handling, storing, or moving materials and packages, are manufactured by arranging a plurality of vertical and horizontal wood members, individually having a predetermined size, so as to allow the members to meet at right angles. Thereafter, the vertical and horizontal members are integrated into a single body using a plurality of nails, screws or rivets at the crosses of the members. For example, in order to form a pallet, a plurality of rectangular wood bars, having the same size and configuration, are arranged in a parallel and regularly spaced arrangement. Thereafter, a plurality of wood plates are regularly arranged on the wood bars so as to meet the wood bars at right angles prior to fastening the wood plates to the wood bars using a plurality of nails at the crosses.

However, such wood pallets are problematic in that it is very difficult to manufacture them since the vertical and horizontal members have to be arranged across each other at right angles and are integrated into a single body by a plurality of nails driven at the crosses one by one. When materials and packages are removed from such wood pallets, the pallets are not reused but are regrettably scrapped, thus causing waste of resources and increasing the circulation expenses of goods and being inconvenient to users.

When such wood pallets are used for storing materials and packages in warehouses with wet air or storing bricks or stones in the open air, the pallets are easily wetted. Such wet wood pallets may be deformed or rotted, thus failing to stably support materials, packages, bricks and stones. Such rotting wood pallets also give out a bad smell irritating those around them.

Another problem experienced in the typical wood pallets is that they can not be effectively used for handling, storing, or moving materials and packages regardless of sizes or configurations of the materials and packages. That is, the typical wood pallets have fixed sizes, so it is necessary to separately produce a plurality of pallets having various sizes so as to meet different sizes of materials and packages, and this causes a reduction in productivity of the pallets.

DISCLOSURE OF THE INVENTION

Accordingly, the present invention has been made keeping in mind the above problems occurring in the prior art, and an object of the present invention is to provide a prefabricated pallet, which comprises a plurality of vertical and horizontal plastic members and is easily and firmly assembled by fitting the vertical and horizontal members to each other without using any nails, screws or rivets and is easily disassembled when necessary.

Another object of the present invention is to provide a prefabricated pallet, of which the size is freely changeable in accordance with the arrangement of the vertical and horizontal members, thus allowing the pallet to be freely used for supporting a material or package regardless of the size of the material or package.

A further object of the present invention is to provide a prefabricated pallet, which has a plurality of pipe insert holes capable of allowing the pallet to be assembled into a many-storied structure, thus enlarging the loading capacity of the pallet.

In order to accomplish the above object, a prefabricated pallet according to the preferred embodiment of the present invention comprises: a plurality of horizontal members arranged in a parallel arrangement and individually having a plurality of vertical fitting holes; and a plurality of vertical members arranged on and across the horizontal members at right angles and individually comprising a longitudinal plate part with a plurality of fitting block parts being formed on the bottom surface of the plate part, the fitting block parts being fitted into the vertical fitting holes of the horizontal members, thus assembling the vertical and horizontal members into a single body.

Each of the fitting block parts of each vertical member is stepped at the outside surface of the lower portion and has a pipe insert hole which is depressed from the top surface of the vertical member to a depth.

Each of the vertical fitting holes of each horizontal member has a size and configuration corresponding to those of each of the fitting block parts, so the fitting block parts are closely inserted into the fitting holes, thus stably and firmly assembling the vertical and horizontal members into a pallet without using any nails, screws or rivets at the crosses.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
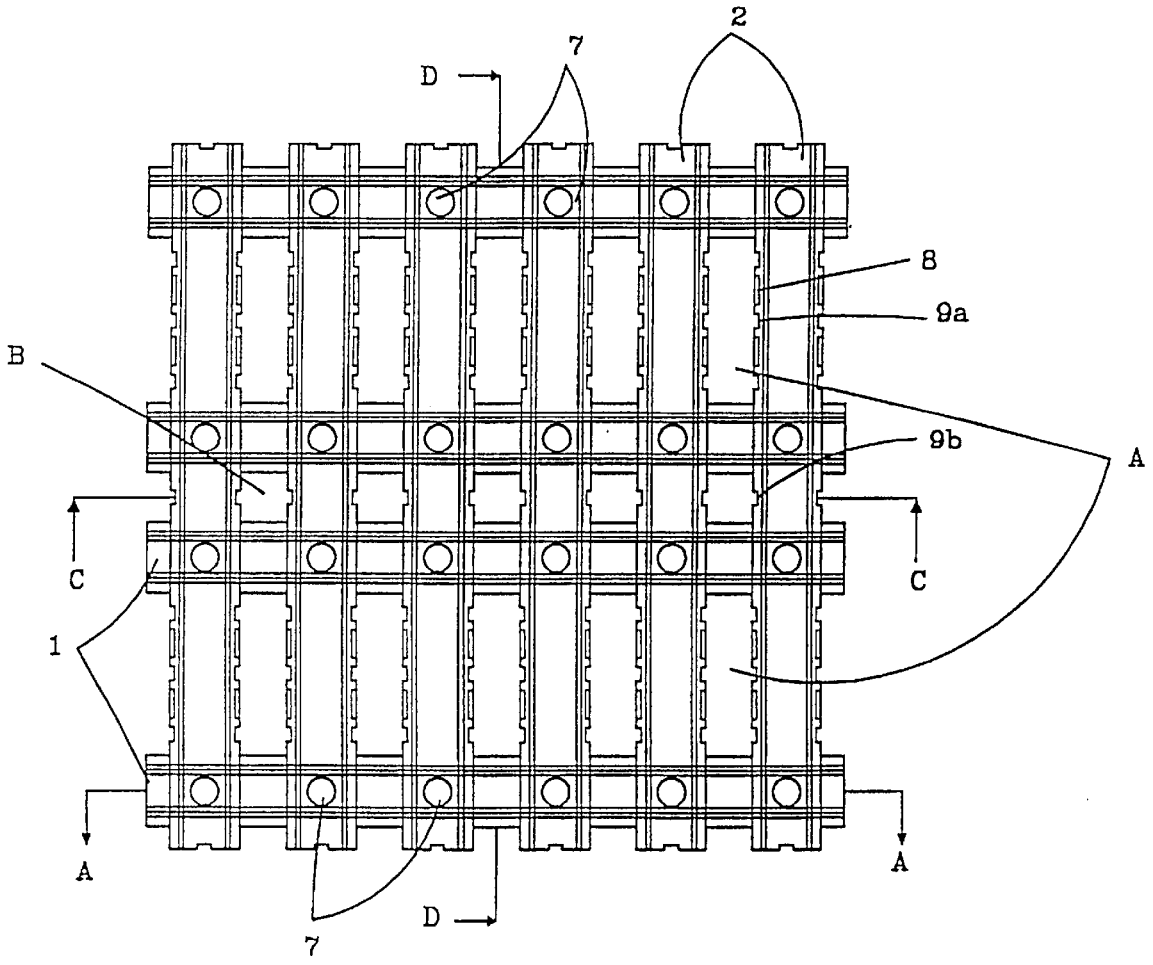
FIG. 1 is a plan view of a prefabricated pallet in accordance with the primary embodiment of the present invention.
Figure 2A:
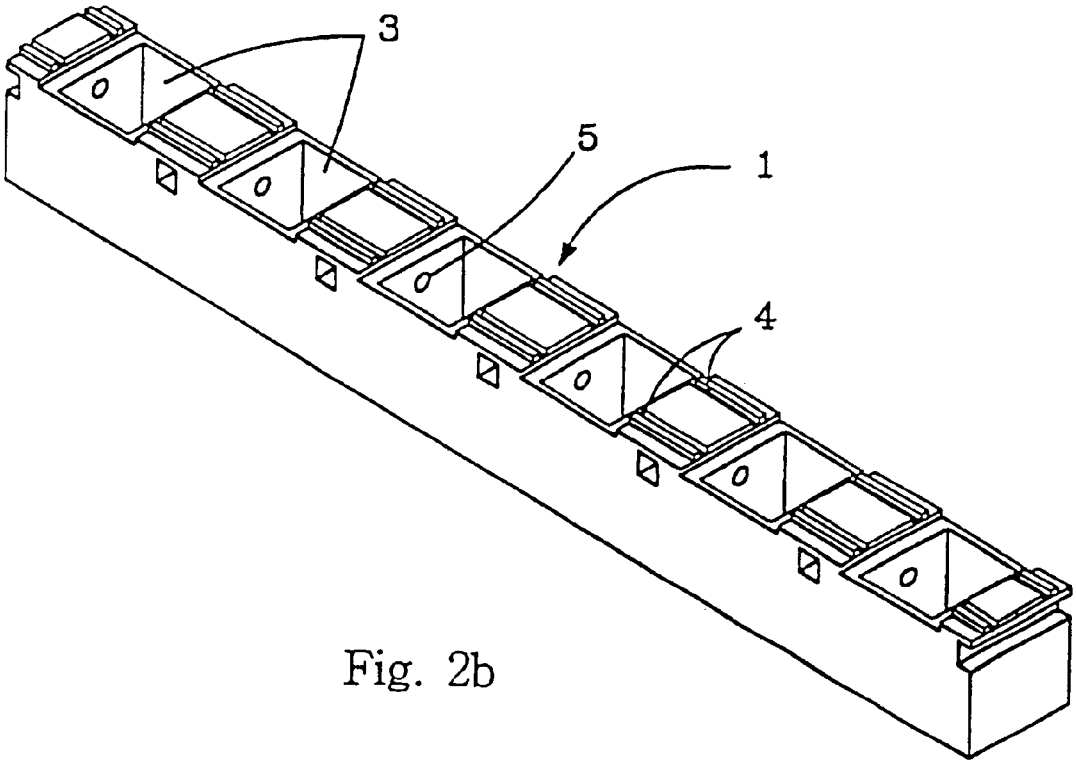
FIGS. 2*a* and 2*b* are a perspective view and a longitudinal sectional view of a horizontal member included in the pallet of this invention, respectively.
Figure 2B:
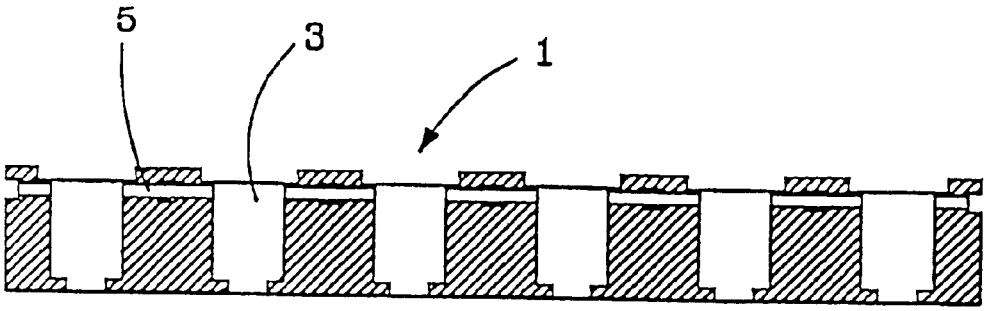
Figure 3A:
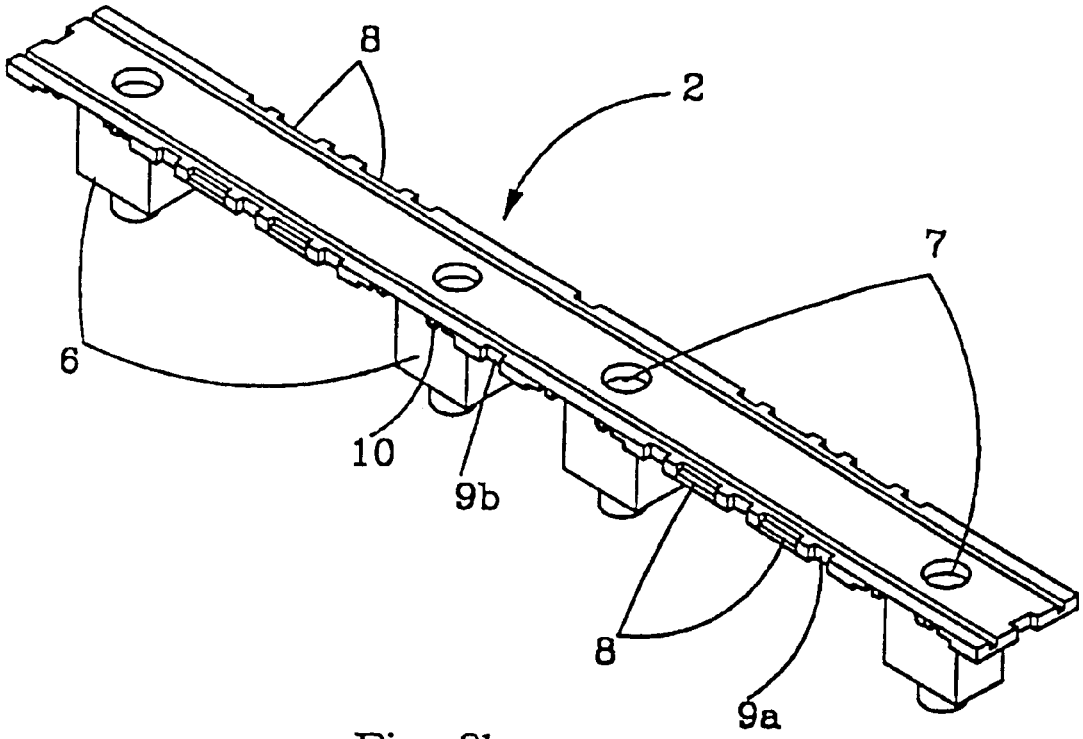
FIGS. 3*a* and 3*b* are a perspective view and a longitudinal sectional view of a vertical member included in the pallet of this invention, respectively.
Figure 3B:
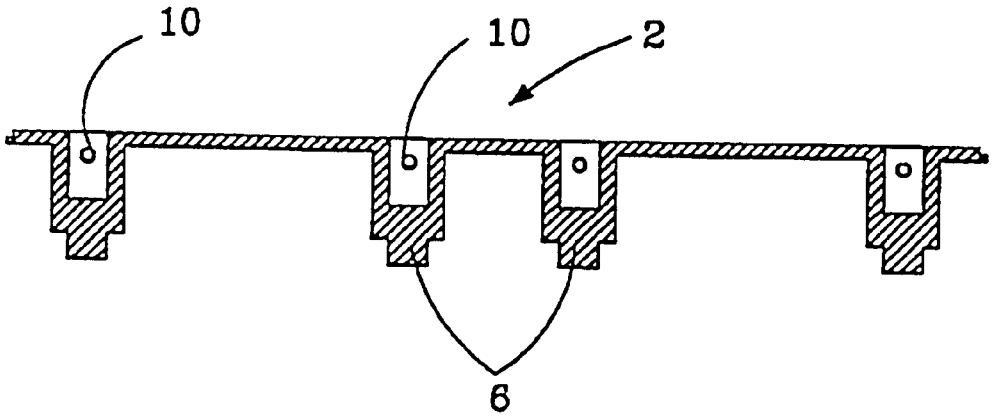

FIG. 1 is a plan view of a prefabricated pallet in accordance with the primary embodiment of the present invention showing, with respect to such plan view, horizontal plan and vertical plan members 1 and 2 respectively. FIGS. 2*a* and 2*b* are views showing the construction of a horizontal member included in the above pallet. FIGS. 3*a* and 3*b* are views showing the construction of a vertical member included in the above pallet.

As shown in FIG. 1, the pallet of this invention comprises a plurality of horizontal members 1 and a plurality of vertical members 2. In the pallet, the horizontal members 1 are arranged in a parallel arrangement, while the vertical members 2 are arranged on the horizontal members 1 so as to meet the horizontal members 1 at right angles. The construction of the horizontal members 1 is shown in FIGS. 2*a* and 2*b*.

FIG. 2*a* is a perspective view of each horizontal member 1, while FIG. 2*b* is a longitudinal sectional view of the horizontal member 1. As shown in the drawings, each of the horizontal members 1 is a longitudinal bar having a rectangular cross-section. The horizontal member 1 also has a plurality of regularly spaced vertical fitting holes 3 with a plurality of ribs being remained between the vertical fitting holes 3. Two linear grooves 4 are longitudinally formed on both sides of the top surface at each of the ribs. In addition, an aperture 5 is longitudinally formed at the center of the upper portion of each rib and selectively receives a coupling rod 13 as will be described later herein. The top surface of the horizontal member 1 is partially depressed to a depth at areas around the fitting holes 3, thus allowing the vertical members 2 to be seated in the depressions at the crosses when the horizontal and vertical members 1 and 2 are assembled into a pallet. Due to such depressions of the horizontal members 1, the top surface of each horizontal member 1 is level with the top surface of each vertical member 2 when the two members 1 and 2 are assembled into a single structure.

Each of the fitting holes 3 has a rectangular cross-section at the upper portion and a circular cross-section at the lower portion, thus having a step at the junction between the two portions having different cross-sections. In such a case, each side of the rectangular cross-sectioned portion is longer than the diameter of the circular cross-sectioned portion and the profile of the stepped side wall of each fitting hole 3 is best seen in FIG. 2*b*. In the present invention, it is preferable to form the horizontal members 1 using a high strength plastic material.

FIG. 3*a* is a perspective view of each of the vertical members 2 which are assembled with the horizontal members 1 into a pallet of this invention, FIG. 3*b* is a longitudinal sectional view of the above vertical member 2. As shown in the drawings, each of the vertical members 2 comprises a longitudinal plate part with a plurality of fitting block parts 6 being formed at the bottom surface of the plate part. In the vertical member 2, a pipe insert hole 7 is formed on the top surface of the plate part at a position around each of the fitting block parts 6. The longitudinal plate part also has a plurality of stepped shoulders 8 and two types of notches 9*a* and 9*b* at each side edge.

In each of the vertical members 2, it is preferable to form one fitting block part 6 at a position around each end and two fitting block parts 6 at the middle position. Each of the fitting block parts 6 has a size and configuration corresponding to those of each fitting hole 3 of the horizontal member 1. That is, the fitting block parts 6 individually comprise a rectangular cross-sectioned part at the upper portion and a circular cross-sectioned part at the lower portion.

An aperture 10 is transversely formed at the upper portion of each of the block parts 6. The above aperture 10 is aligned with the apertures 5 of the horizontal member 1 and selectively receives a coupling rod 13. In the present invention, it is preferable to form the vertical members 2 using a high strength plastic material.

Figure 4A:
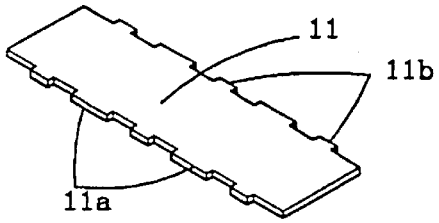
FIGS. 4*a* and 4*b* are perspective views of two types of filling plates respectively seated on two types of openings of the pallet according to this invention.
Figure 4B:
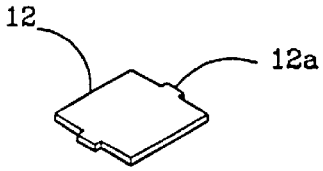

FIGS. 4*a* and 4*b* are perspective views of two types of filling plates respectively seated on two types of openings of the above pallet. That is, the first filling plates or the larger plates 11 of FIG. 4*a* are seated on the peripheral openings "A" of the pallet of FIG. 1, while the second filling plates or the small plates 12 are seated on the central openings "B" of the pallet.

The first filling plate 11 has the same size and configuration as those of each peripheral opening "A" of the pallet, thus effectively covering the opening "A". The above peripheral openings "A" are defined by the horizontal and vertical members 1 and 2 at both sides of the pallet. A plurality of wide and narrow protrusions 11*a* and 11*b* are alternately formed at each side edge of the first filling plate 11. When the first filling plate 11 is seated on the opening "A" of the pallet, the wide protrusions 11*a* are seated on the stepped shoulders 8 of the vertical member 2, while the narrow protrusions 11*b* are seated in the first notches 9*a* of the vertical member 2.

The second filling plate 12 has two protrusions 12*a* at opposite side edges, so the plate 12 is stably seated on a central opening "B" of the pallet with the two protrusions 12*a* being seated in the second notches 9*b* of two vertical members 2 positioned around the opening "B". In such a case, the other two side edges of the plate 12, free from such a protrusion 12*a*, are seated on the depressed top surfaces of two horizontal members 1 positioned around the opening "B".

Of course, it should be understood that the pallet of this invention may be used without having either the first filling plate 11 or the second filling plates 12. However, such filling plates 11 and 12 may be preferably used when it is necessary to cover the openings "A" and "B" of the pallet since materials or packages supported by the pallet are too small to be prevented from passing through the openings "A" and "B".

When the openings "A" and "B" of the pallet are completely covered with the filling plates 11 and 12, the pallet has a simple flat top surface with a plurality of pipe insert holes 7. In the same manner as that described for the horizontal and vertical members 1 and 2, the first and second filling plates 11 and 12 are preferably formed of a high strength plastic material.

Figure 5:
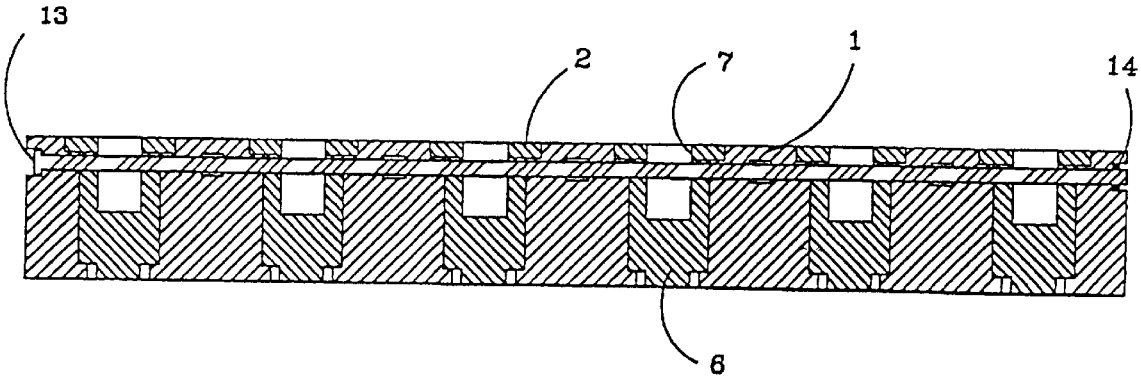
FIG. 5 is a sectional view of the pallet taken along the line A—A of FIG. 1.

FIG. 5 is a sectional view of the pallet taken along the line A—A of FIG. 1 and shows the coupling structure between the horizontal and vertical members 1 and 2.

In order to assemble the horizontal and vertical members 1 and 2 into a pallet, the horizontal members 1 are arranged in a parallel arrangement prior to arranging the vertical members 2 on and across the horizontal members 1 at right angles. Thereafter, the horizontal and vertical members 1 and 2 are assembled into a pallet through a fitting process. That is, the fitting block parts 6 of the vertical members 2 are fitted into the fitting holes 3 of the horizontal members 1 as shown in FIG. 5, thus accomplishing the assembling process of the pallet. In such a case, the rectangular and circular cross-sectioned parts of each block part 6 are almost completely and closely fitted into the rectangular and circular cross-sectioned parts of each fitting hole 3, respectively. In addition, the lower end of each block part 6 is level with the bottom surface of the horizontal member 1.

As described above, the pallet of this invention is easily and firmly assembled by fitting the horizontal and vertical members 1 and 2 to each other without using any nails, screws or rivets.

However, the horizontal members 1 may be unexpectedly disassembled from the vertical members 2 when the pallet is lifted and moved along with materials and packages by a fork-lift truck. In order to prevent such an unexpected disassembling of the pallet, the horizontal and vertical members 1 and 2 are somewhat precisely arranged in a way such that the apertures 5 of the horizontal members 1 are aligned with the apertures 10 of the vertical members 2. Thereafter, a plurality of coupling rods 13 are inserted into the aligned apertures 5 and 10 prior to tightening two nuts 14 to both ends of each coupling rod 13 as shown in FIG. 5. The horizontal members 1 are thus fixed to the vertical members 2, so the pallet is not unexpectedly disassembled when it is lifted or moved along with materials and packages by a fork-lift truck.

In the above embodiment, the horizontal and vertical members 1 and 2 have the same length, so the pallet, formed by assembling such horizontal and vertical members 1 and 2 into a single structure, has a regular square configuration with a fixed size. However, the size and configuration of the pallet may be changed into various sizes and configurations in accordance with use of the pallet. That is, the pallet may be cut along the line C—C of FIG. 1, thus being divided into two rectangular pallets. The pallet also may be cut along the two lines C—C and D—D of FIG. 1, thus being divided into four small-sized regular square pallets. Of course, it should be understood that the cutting lines of the pallet may be freely changed in accordance with use of the pallet.

Alternately, the size of the pallet also may be enlarged. For example, when it is necessary to enlarge the vertical size of the pallet, the vertical members 2 are arranged in a way such that their ends are alternately recessed. Thereafter, two additional horizontal members 1 are arranged across the alternately protruded ends of the vertical members 2 at right angles at both sides of the pallet. Meanwhile, when it is necessary to enlarge the horizontal size of the pallet, the horizontal members 1 are arranged in a way such that their ends are alternately recessed. Thereafter, two additional vertical members 2 are arranged across the alternately protruded ends of the horizontal members 1 at right angles.

Figure 6:
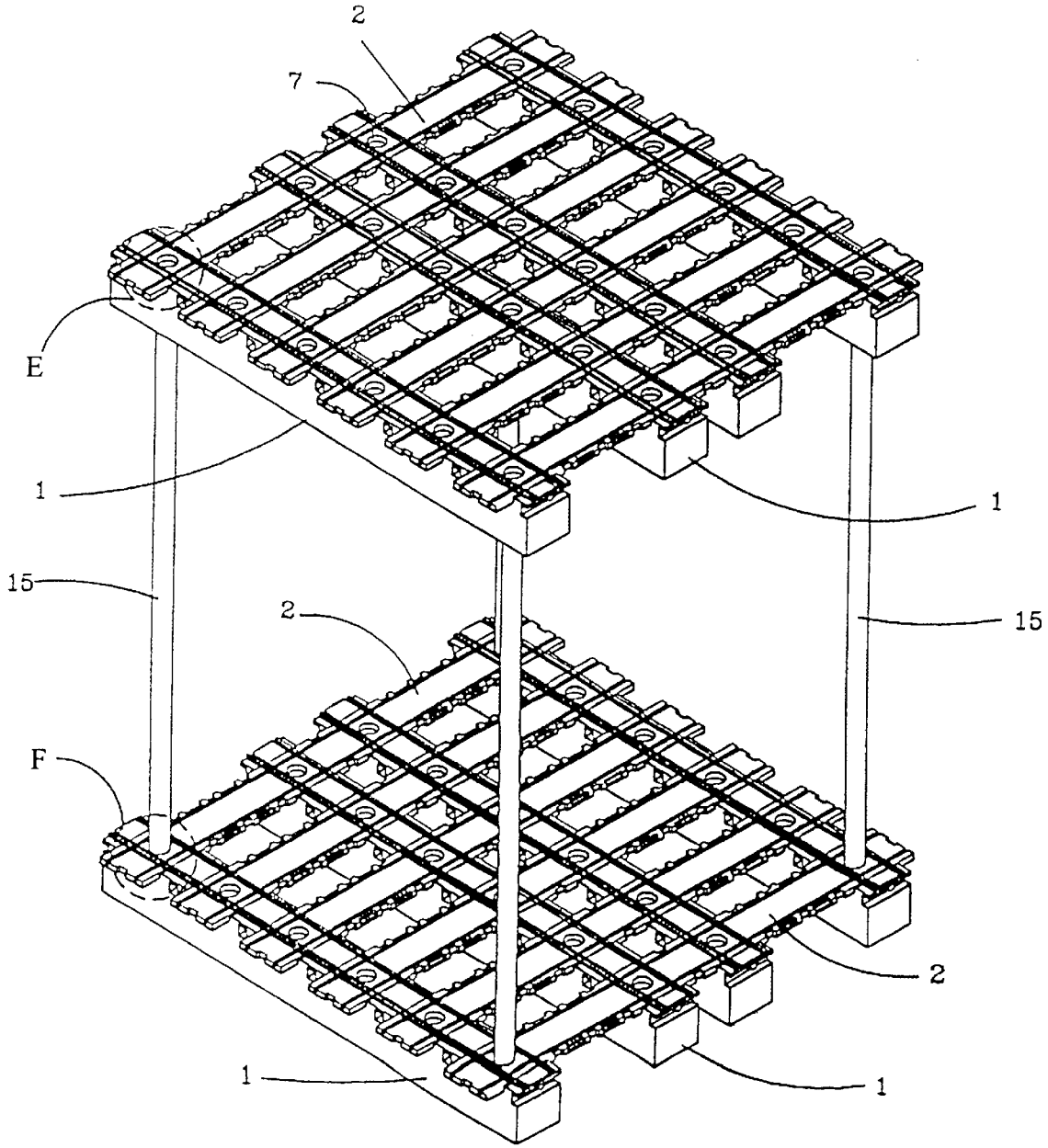
FIG. 6 is a perspective view of a two-storied prefabricated pallet in accordance with another embodiment of the present invention.

FIG. 6 is a perspective view of a prefabricated pallet in accordance with the second embodiment of the present invention. In the second embodiment, the pallet has a two-storied structure. That is, the pallet according to the second embodiment is formed by arranging two pallets of FIG. 1 up and down with a plurality of connection pipes 15 being vertically positioned between the two pallets.

Figure 7A:
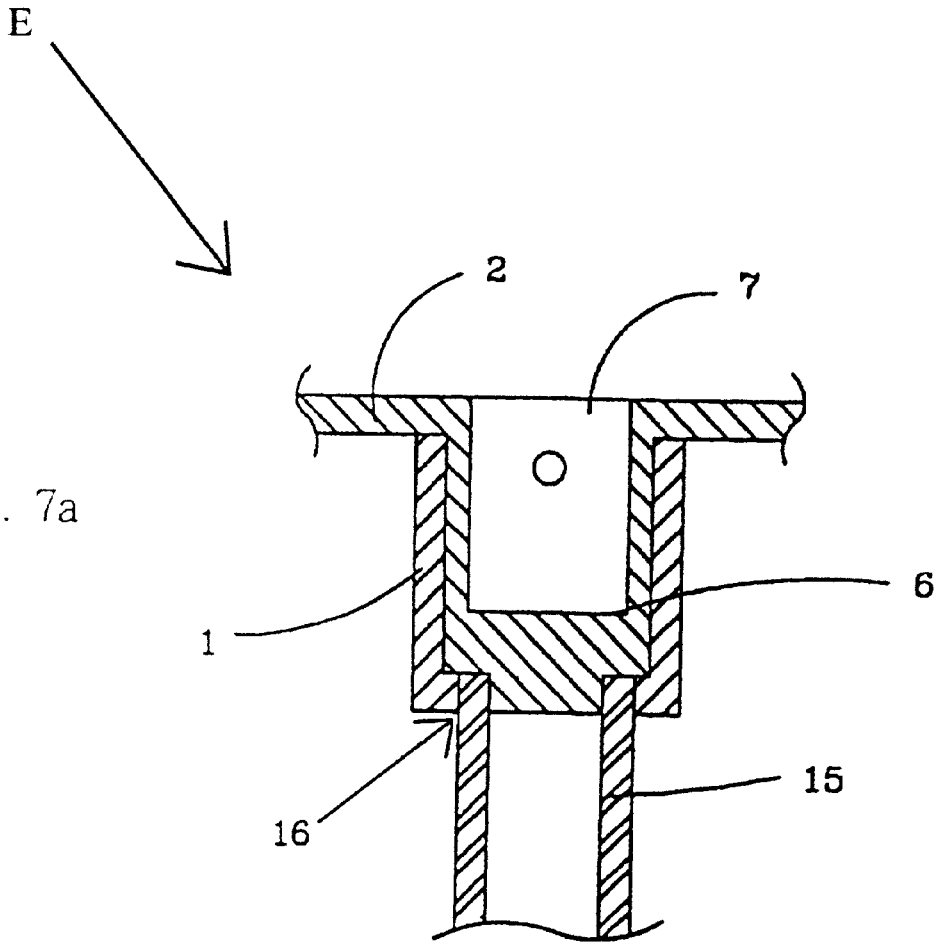
FIGS. 7*a* and 7*b* are sectional views of the coupling portions "A" and "B" of FIG. 6, respectively.
Figure 7B:
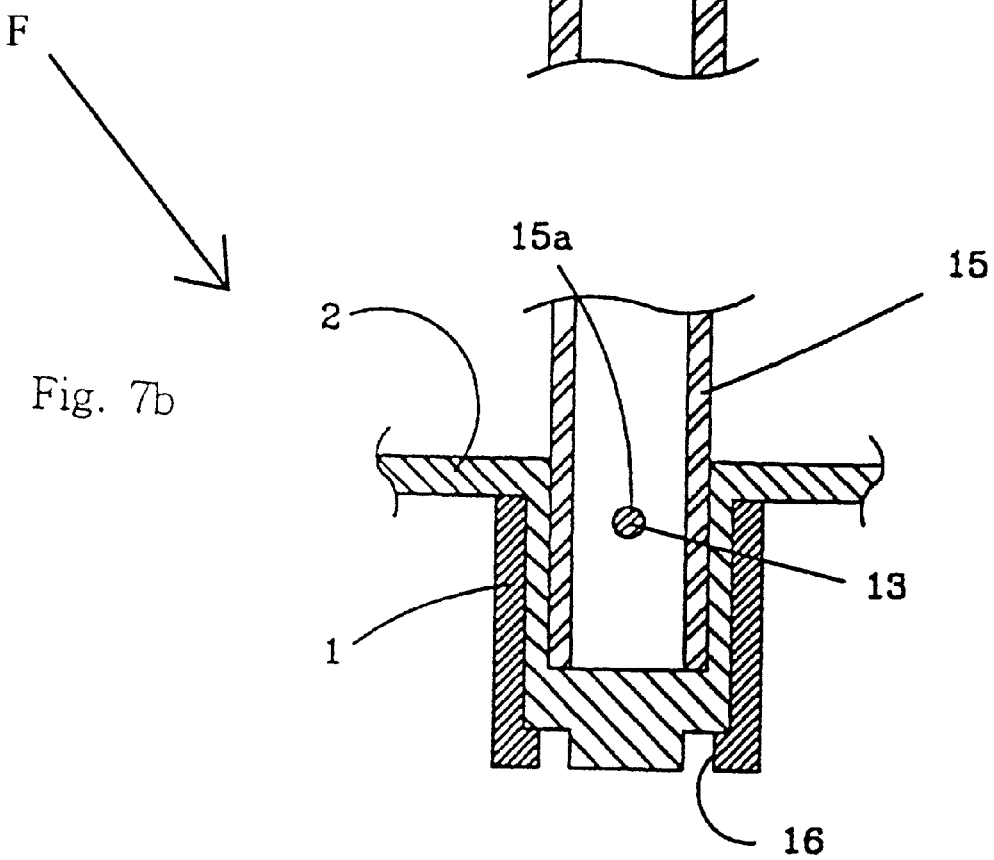

The upper and lower coupling structures for coupling the connection pipes 15 to the upper and lower pallets are shown in FIGS. 7*a* and 7*b*.

FIG. 7*a* shows the upper coupling structure for coupling the top end of each connection pipe 15 to the upper pallet. As shown in the drawing, the top end of each connection pipe 15 is fitted into an annular fitting groove 16, which is defined between the lower portion of each fitting block part 6 of the vertical member 2 and the lower portion of each fitting hole 3 of the horizontal member 1.

Meanwhile, FIG. 7*b* shows the lower coupling structure for coupling the lower end of each connection pipe 15 to the lower pallet. As shown in the drawing, the lower end of each connection pipe 15 is fitted into a pipe insert hole 7 of the vertical member 2. The lower end of the connection pipe 15 has a transverse aperture 15*a*, so the connection pipe 15 can be fixed to the pipe insert hole 7 by a coupling rod 13 and is effectively prevented from an unexpected separation from the pipe insert hole 7.

The pallet of FIG. 6 has a two-storied structure, so the pallet supports materials and packages on the upper and lower pallets, thus enlarging the loading capacity. Of course, it should be understood that such a many-storied pallet of this invention is not limited to the two-storied structure but may have three or more-storied structure. In addition, the number of connection pipes 15, provided between the upper and lower pallets, may be freely changed in accordance with weight of materials and packages supported by the upper pallet.

The many-storied pallet of FIG. 6 also may be provided with four side walls, which are fitted in and held by the grooves of the outermost horizontal and vertical members 1 and 2 of the upper and lower pallets, thus being formed as a box-shaped pallet. Such a box-shaped pallet almost completely covers materials and packages, thus effectively protecting them from the outside.

Industrial Applicability

As described above, the present invention provides a prefabricated pallet, which comprises a plurality of vertical and horizontal plastic members and is easily and firmly assembled by fitting the vertical and horizontal members to each other without using any nails, screws or rivets and is easily disassembled when necessary. Therefore, the pallet of this invention improves productivity when it is assembled. When it is necessary to move the pallets so as to reuse or store the pallets, the pallets are easily disassembled. Such disassembled pallets have a reduced volume and are convenient to users while being moved.

The above pallet also may be freely changed into various sizes by changing the arrangement of the vertical and horizontal members, thus effectively supporting materials or packages regardless of the size and configuration of the materials or packages. The pallet also may have a many-storied structure with a plurality of connection pipes being vertically positioned between upper and lower pallets, so the pallet has an enlarged loading capacity.

Another advantage of the pallet of this invention resides in that the pallet is formed of a plastic material effectively resisting against moisture, thus being not wetted different from typical wood pallets even when the pallets are stored in a wet environment. Therefore, the pallet of this invention is almost completely prevented from being deformed or rotted, thus being effectively used for a lengthy period of time.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. Prefabricated pallet, comprising:

a plurality of first members arranged in a parallel arrangement, each of said first members having a plurality of vertical fitting holes formed along the length of the first member; and a plurality of second members arranged on said first members so as to meet the first members at right angles, each of said second members comprising a longitudinal plate part with a plurality of fitting block parts being formed on a bottom surface of the plate part and a pipe insert hole being formed on a top surface of said plate part at a position around each of said fitting block parts, said fitting block parts being fitted into said vertical holes of the first members, thus assembling the first and second members into a single body.

2. The prefabricated pallet according to claim 1, further comprising a plurality of filling plates used for covering openings formed on a top surface of the pallet at positions between the first and second members.

3. The prefabricated pallet according to claim 1, further comprising a coupling rod longitudinally passing through each of the first members while transversely passing through fitting block parts of the second members fitted into the vertical fitting holes of each of said first members.

* * * * *

UNITED STATES PATENT AND TRADEMARK OFFICE

CERTIFICATE OF CORRECTION

PATENT NO. : 6,186,077 B1
DATED : February 13, 2001
INVENTOR(S) : Lim et al.

It is certified that error appears in the above-identified patent and that said Letters Patent is hereby corrected as shown below:

Column 5,
Line 51, after "structures" insert -- E and F respectively --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*